US006752478B1

(12) United States Patent
Francz

(10) Patent No.: US 6,752,478 B1
(45) Date of Patent: Jun. 22, 2004

(54) GUIDE FITTINGS FOR PULLING OUT DRAWERS

(75) Inventor: Thomas Francz, Hohenems (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 100 days.

(21) Appl. No.: 09/914,446

(22) PCT Filed: Jan. 8, 2001

(86) PCT No.: PCT/AT01/00006

§ 371 (c)(1),
(2), (4) Date: Aug. 28, 2001

(87) PCT Pub. No.: WO01/50917

PCT Pub. Date: Jul. 19, 2001

(30) Foreign Application Priority Data

Jan. 14, 2000 (AT) ..... 50/2000
Mar. 10, 2000 (AT) ..... 401/2000
Oct. 27, 2000 (AT) ..... 1835/2000

(51) Int. Cl.[7] ..... A47B 88/00
(52) U.S. Cl. ..... 312/334.1; 312/319.1
(58) Field of Search ..... 312/330.1, 331, 312/333, 334.1, 334.8, 319.1, 334.7, 334.16, 334.44; 384/20, 22

(56) References Cited

U.S. PATENT DOCUMENTS

| | | | | |
|---|---|---|---|---|
| 889,168 | A | | 5/1908 | Zöpfchen et al. |
| 1,595,723 | A | | 8/1926 | Norton |
| 1,758,550 | A | | 5/1930 | Wolters |
| 1,902,795 | A | | 3/1933 | Wolters |
| 2,650,386 | A | | 9/1953 | Edwards |
| 3,639,028 | A | | 2/1972 | Black |
| 3,952,365 | A | | 4/1976 | Grisebach |
| 4,003,614 | A | | 1/1977 | Geer et al. |
| 4,302,864 | A | | 12/1981 | Morita |
| 4,320,934 | A | | 3/1982 | Röck et al. |
| 4,383,707 | A | | 5/1983 | Nishimura |
| 4,494,806 | A | | 1/1985 | Williams et al. |
| 4,635,763 | A | | 1/1987 | Omata |
| 4,828,344 | A | * | 5/1989 | Omata ..... 312/319.1 |
| 4,872,239 | A | | 10/1989 | Ferguson et al. |

(List continued on next page.)

FOREIGN PATENT DOCUMENTS

| | | |
|---|---|---|
| AT | 002276 | 7/1998 |
| DE | 2421657 | 11/1975 |
| DE | 9411701.2 | 11/1994 |
| DE | 29621957 | 4/1997 |
| DE | 29616054 | 2/1998 |
| DE | 29916841 | 2/2000 |
| EP | 0391221 | 10/1990 |
| EP | 0556613 A1 | 8/1993 |
| GB | 2022992 | 12/1979 |
| GB | 2245157 | 1/1992 |
| GB | 2245158 | 1/1992 |
| JP | 5-317133 | 12/1993 |
| WO | 97/31559 | 9/1997 |

*Primary Examiner*—James O. Hansen
(74) *Attorney, Agent, or Firm*—Wenderoth, Lind & Ponack, L.L.P.

(57) ABSTRACT

A pull-out guide assembly for a drawer (1) has, on both sides of the drawer (1), a respective pull-out rail (5) on the drawer side and a respective support rail (3) on a furniture body side. Where appropriate, a central rail (6) is arranged displaceably between the support rail (3) and the pull-out rail (5). The pull-out rail (5) is inserted in a drawer side wall and fixed therein. A damper which damps the push-in movement of the pull-out rail (5) before the latter reaches the rear end position is provided. The damper (10) acts on a slide (9) which is guided displaceably on the pull-out rail (5). The slide (9) has a stop (8) by means of which it abuts against the body rail (3) or the central rail (6) before the pull-out rail (5) reaches its rear end position.

20 Claims, 5 Drawing Sheets

U.S. PATENT DOCUMENTS 4,894,883 A 1/1990 Fleischhauer
4,948,103 A 8/1990 Bowden et al.
5,169,221 A 12/1992 Wheeler
5,201,512 A * 4/1993 Rabin ..... 312/319.1 X
5,207,781 A 5/1993 Röck
5,474,375 A 12/1995 Hollenstein et al.
5,492,400 A * 2/1996 Rock ..... 312/331
5,658,058 A 8/1997 Bivens et al.
5,890,692 A 4/1999 Lee et al.
6,154,924 A 12/2000 Woo
6,266,847 B1 7/2001 Krumhauer
6,408,483 B1 6/2002 Salice

* cited by examiner

GUIDE FITTINGS FOR PULLING OUT DRAWERS

The invention relates to a pull-out guide assembly for drawers having on both sides of the drawer a respective pull-out rail on a drawer side and a respective support rail on a furniture body side. Where appropriate, a central rail is arranged displaceably between the support rail. The pull-out rail is preferably insert in the drawer side wall and being fixed therein, and has a damper which damps the push-in movement of the pull-out rail before the latter reaches a rear end position.

SUMMARY OF THE INVENTION

The object of the invention is to better integrate the damper in the pull-out guide assembly.

The object according to the invention is achieved in that the damper acts between the pull-out rail and a slide which is guided displaceably on the pull-out rail. The slide has a stop by means of which it abuts against the body rail or the central rail before the pull-out rail reaches its rear end position.

Advantageously, the damper is borne on or in the slide, the pull-out rail having an abutment for the damper.

Advantageously, the damper is constructed as a fluid damper, with air or a liquid, preferably an oil, being used as the damping medium.

An exemplary embodiment of the invention will be described below with reference to the figures in the attached drawings.

DETAILED DESCRIPTION OF THE PREFERRED EMBODIMENTS

Figure 1:
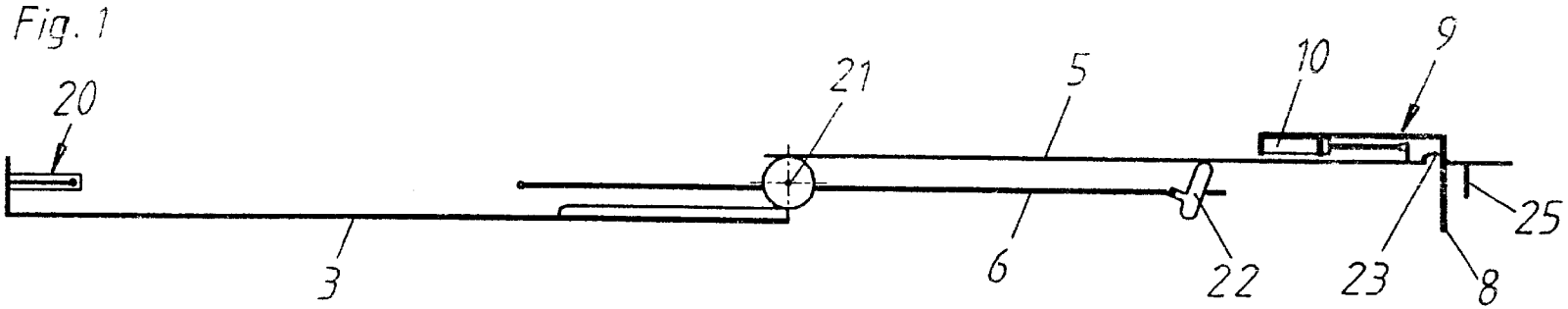
FIG. 1 shows a diagrammatical side view of a pull-out guide assembly according to the invention in a fully pulled out position.
Figure 2:
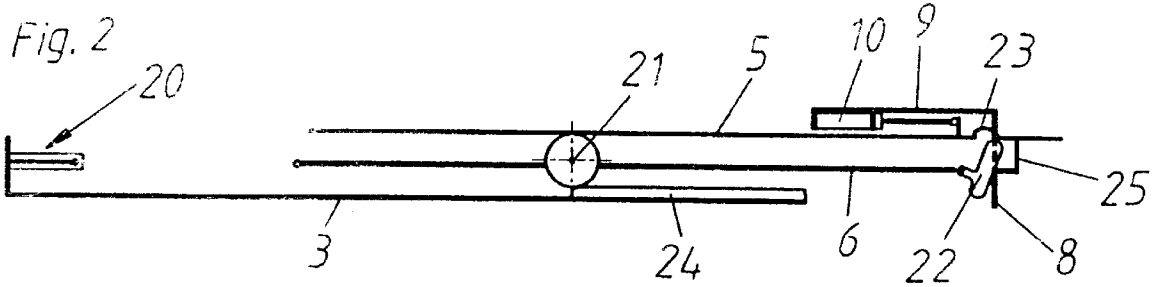
FIGS. 2 to 5 show side views of this pull-out guide assembly according to the invention in various intermediate positions.

The pull-out guide assembly according to the invention has, on each side of a drawer 1, a support rail 3 secured to a furniture body side wall 2, a pull-out rail 5 arranged on the drawer 1 within a drawer side wall 4, and a central rail 6 running between the rails 3 and 5.

The load between rails 3, 5, and 6 is transmitted in a conventional manner by way of rollers and/or glide means, preferably by way of rollers borne in a running carriage.

A damping mechanism 7 is borne on the pull-out rail 5 and comprises a slide 9 and a damper 10, which in the exemplary embodiment according to FIGS. 1 to 9 is borne in the slide 9. In both the exemplary embodiments shown, the damper 10 is constructed as a fluid damper having a cylinder and a piston which can move linearly therein. The piston has a piston rod 11 which in the embodiment according to FIGS. 1 to 9 bears a plunger 12. The damper 10 may be constructed either as an air damper or as a liquid damper. The slide 9 has a stop 8. The slide 9 is constructed in the manner of a housing and the damper 10 is inserted into the slide 9 and held by means of a screw 13 around the slide 9.

When the drawer 1 is closed the stop 8 of the slide 9 strikes against a front end 14, which act as a counter stop. The support rail 3 and the slide 9 cannot move further.

The pull-out rail 5, on the other hand, is moved further into the furniture body together with the drawer 1. An abutment 15 thereof presses against the plunger 12 and thus pushes the piston of the damper 10 into the cylinder, in opposition to the resistance of the damping liquid or air. This results in gentle damping of the inward movement of the drawer 1 and prevents a front panel 16 from striking against the body side walls 2 with great force.

In the embodiment shown, the abutment 15 is not constructed directly on the pull-out rail 5 but is part of a mounting 17 for the damping mechanism 7, which is rigidly connected to the pull-out rail 5. In this connection, the abutment 15 projects through a slot 18 in the slide 9. The slide 9 is surrounded by the mounting 17 in a U-shaped arrangement.

When the drawer 1 is opened the slide 9 is brought back into its ready position by a spring integrated in the damper 10.

Figure 7:
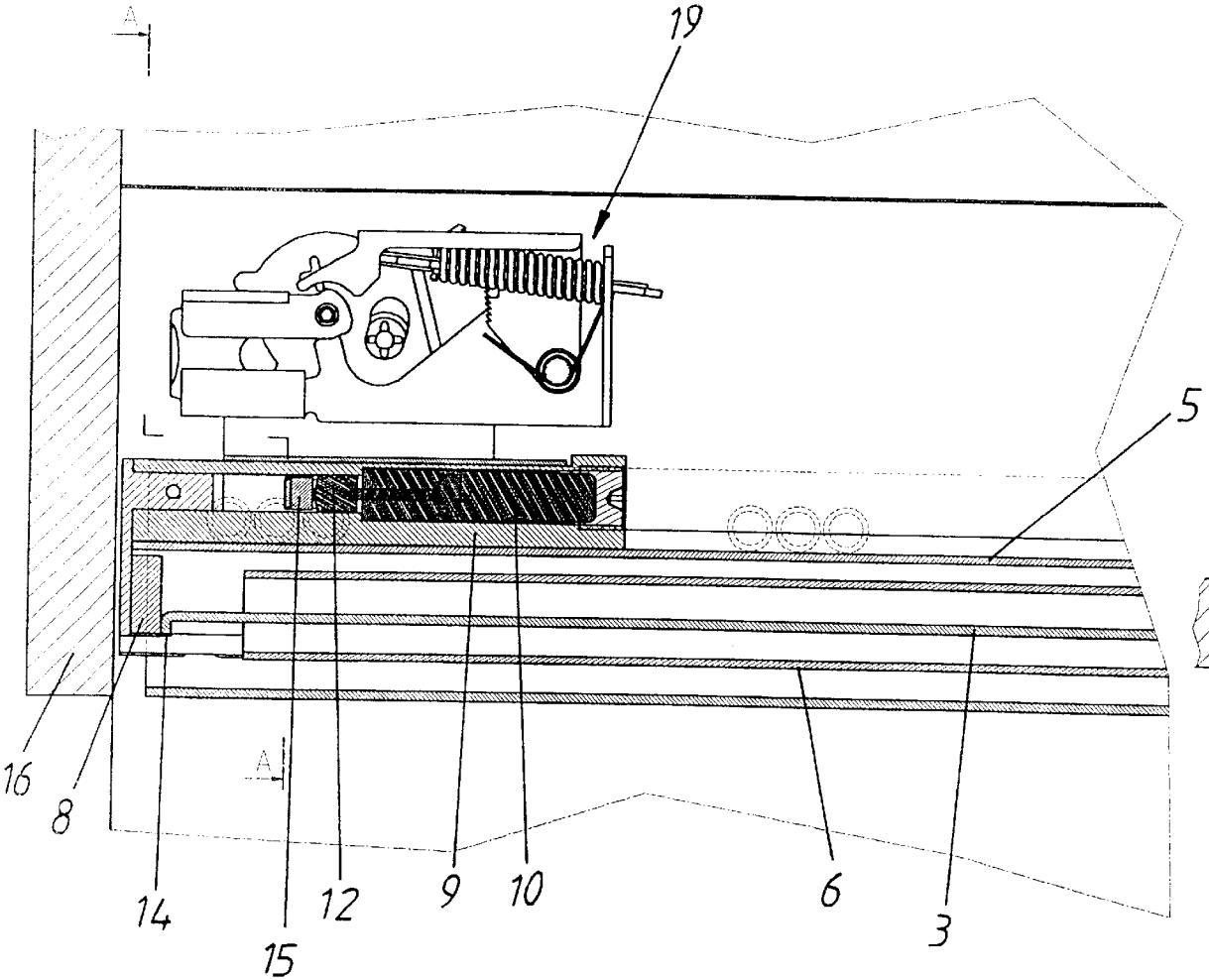
FIG. 7 shows a side view of the front region of the pull-out guide assembly according to the invention with the drawer closed.
Figure 9:
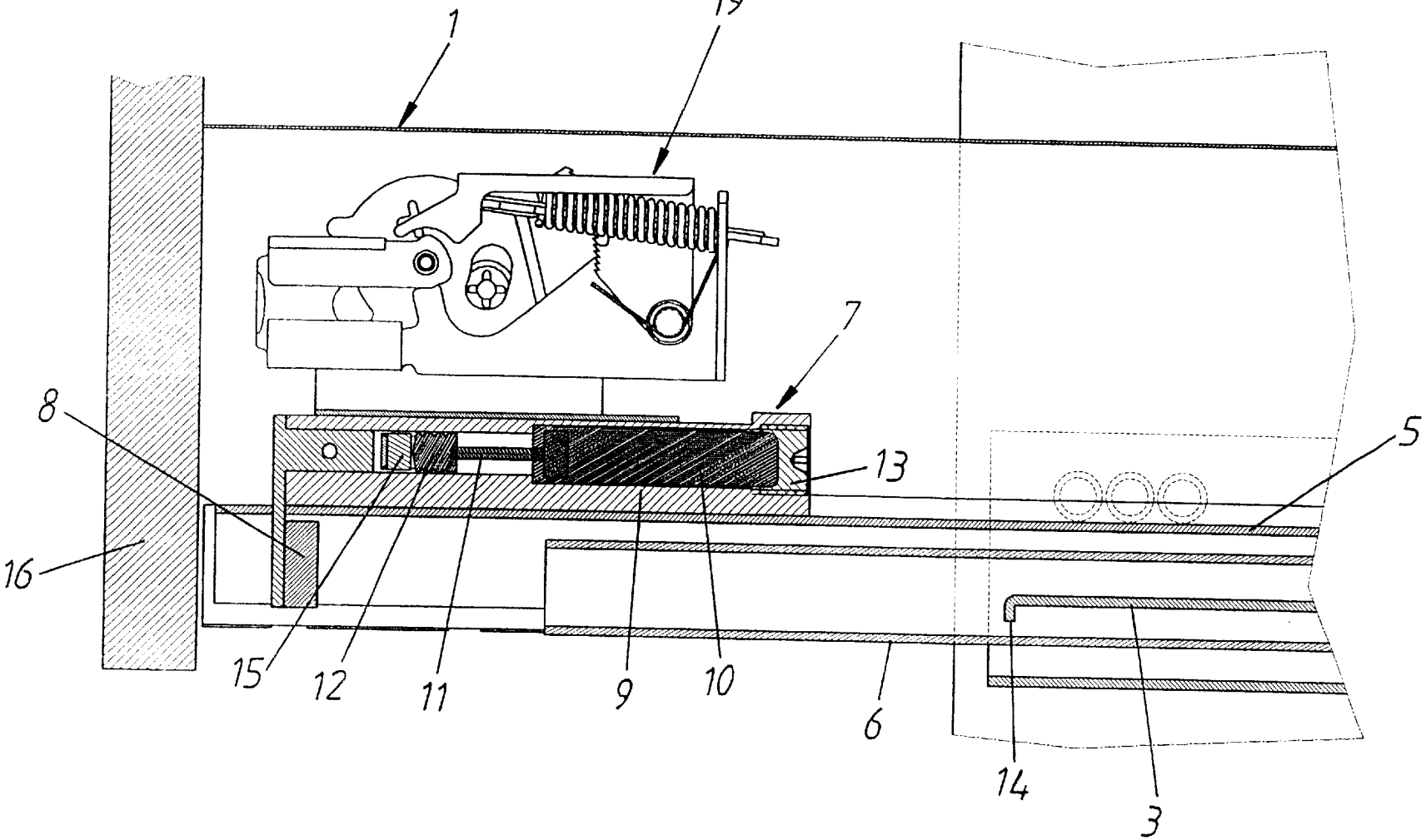
FIG. 9 shows a side view of a front region of the pull-out guide assembly according to the invention with the drawer partly pulled out.

FIGS. 7 and 9 also show a securing means 19 for the front panel 16 in order to illustrate the position of the damping mechanism 7.

Figure 10:
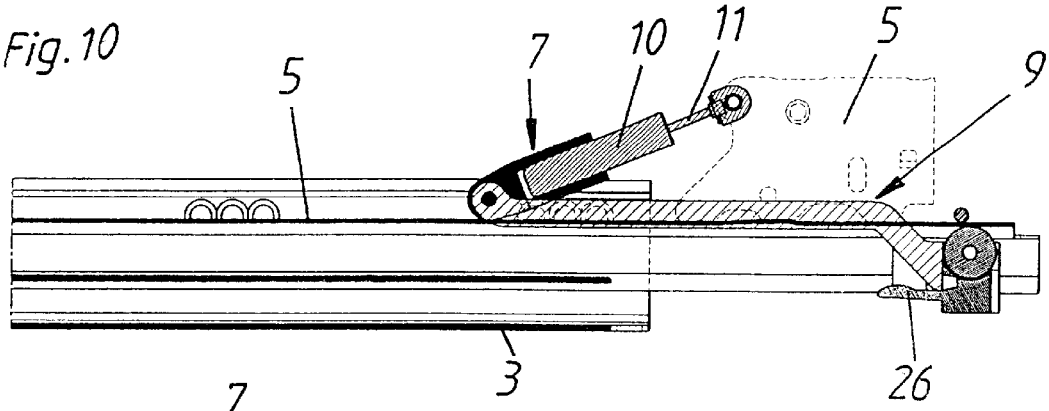
FIG. 10 shows a side view of a further exemplary embodiment of a pull-out guide assembly according to the invention in the region of a damper and with the drawer open.
Figure 11:
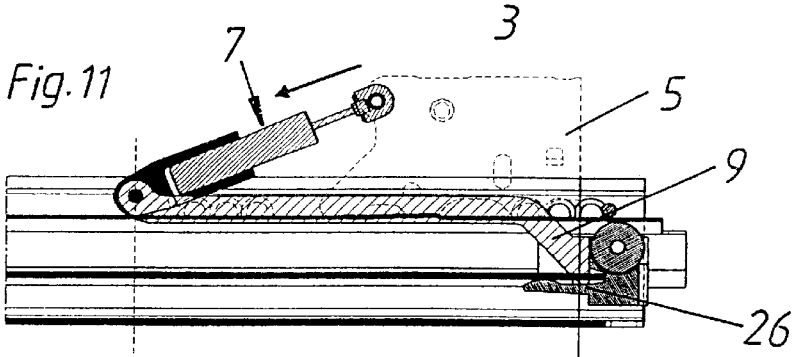
FIG. 11 shows a side view of this pull-out guide assembly, the drawer having been pushed into a furniture body far enough for damping action to begin.
Figure 12:
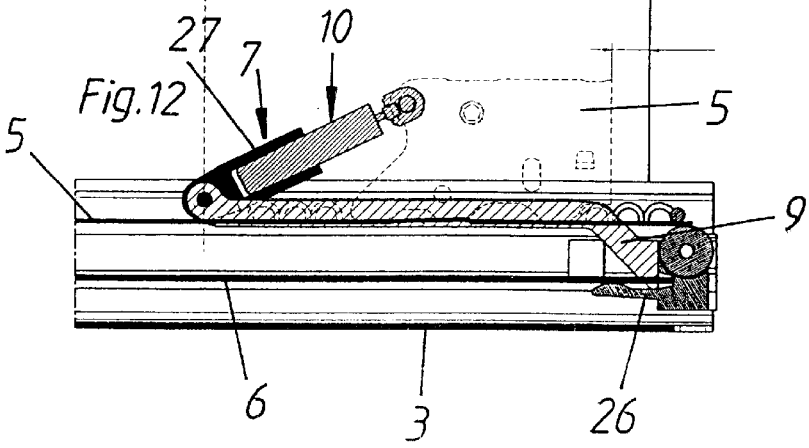
FIG. 12 shows a side view of this pull-out guide assembly with the drawer pushed completely into the furniture body.

FIGS. 10 to 12 shown an exemplary embodiment in which the slide 9 abuts against the front end of the central rail 6. When the pull-out rail 5 is moved further back relative to the slide 9, the piston of the damper 10 is pushed into the cylinder and the push-in movement of the drawer 1 is damped.

In this embodiment, the damper 10 is borne in a tube 27 which is articulated in tiltable manner on the slide 9. The free end of the piston rod 11 of the damper 10 is borne on the pull-out rail 5. During damping, the damper 10 performs a slight tilting movement.

A hook 26 is provided on the slide 9 which reaches below the central rail 6 in the pushed-in position.

In the embodiments shown, a pull-in device 20 is arranged at the rear end of the support rail 3. A friction wheel 21, which may, where appropriate, also be provided with a toothed ring, is borne on the central rail 6.

At its front end, the central rail 6 is provided with a coupling device by way of which the central rail 6 may be coupled to the pull-out rail 5. The coupling device includes a lever 22 which is borne in tiltable manner on the central rail 6 and latches into a recess 23 in the pull-out rail 5 in the coupled position.

At the beginning of the closing movement, the central rail 6 and the pull-out rail 5 run in a different manner with respect to one another, since the friction wheel 21 lies on a friction face 24 and the pull-out rail 5 is supported against the friction wheel 21. Once the central rail 6 and the pull-out rail 5 have reached the position shown in FIG. 2, the friction wheel 21 leaves the friction face 24 and the control action of the friction wheel 21 is no longer effective.

Instead, a stop 25 of the pull-out rail 5 abuts against the front end of the central rail 6, and the central rail 6 is pushed further into the body by the pull-out rail 5.

Figure 3:
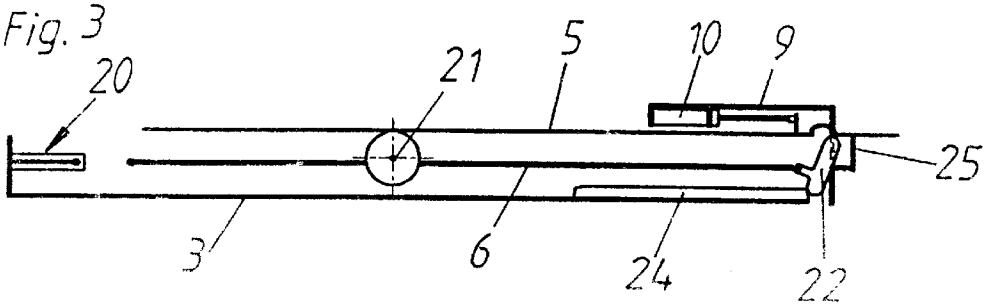
Figure 4:
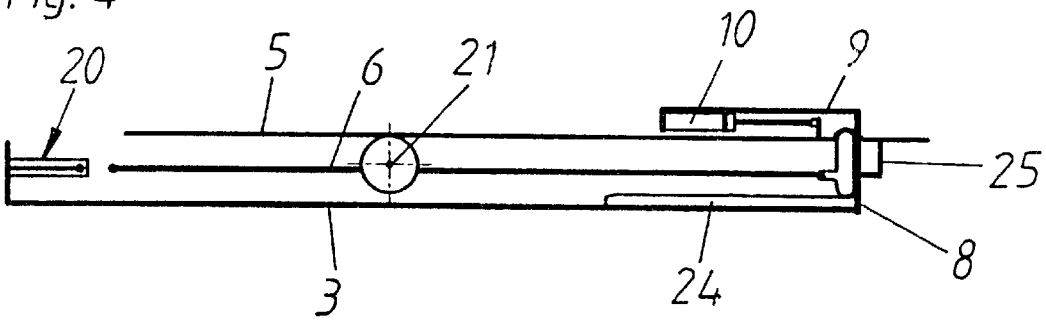
Figure 5:
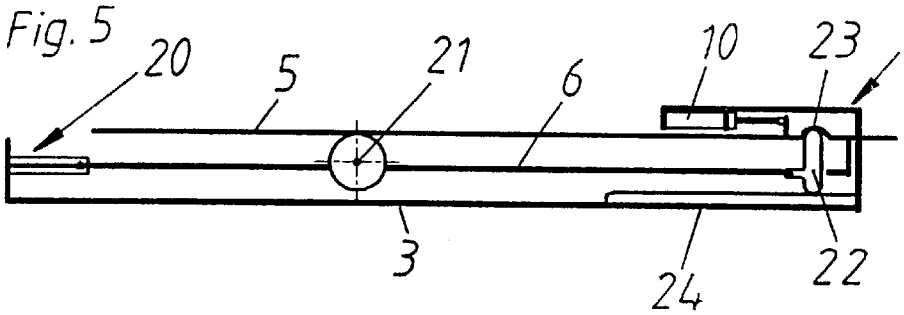
Figure 6:
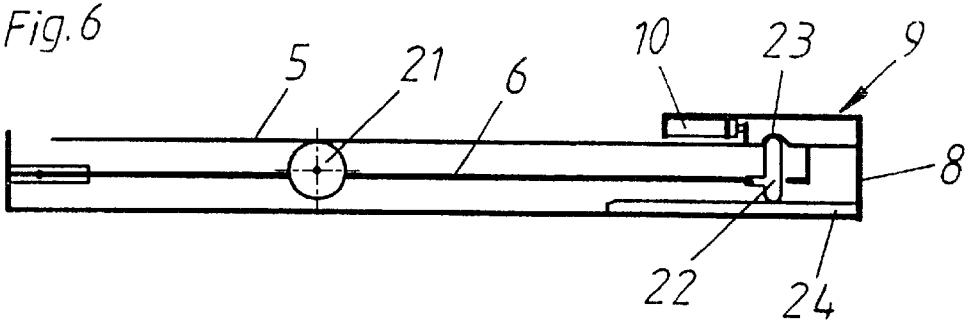
FIG. 6 shows a side view of this pull-out guide assembly in the closed position.
Figure 8:
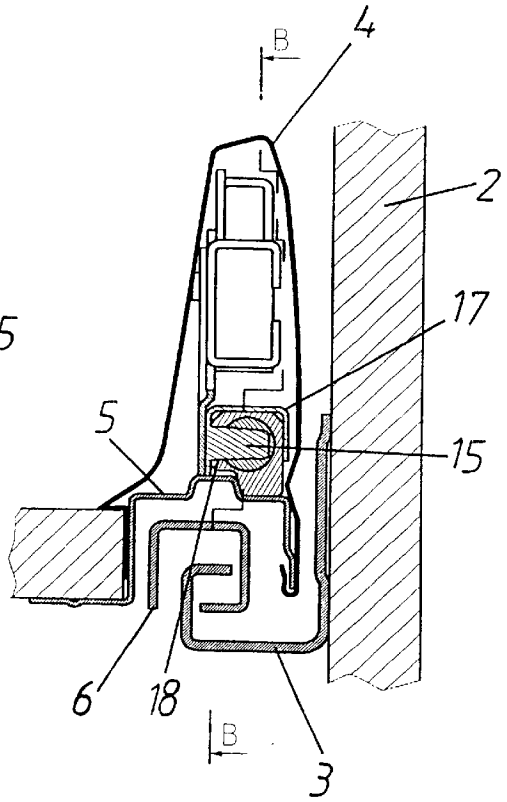
FIG. 8 shows a section along the line A—A in FIG. 7.

Once the central rail 6 and the pull-out rail 5 have reached the position shown in FIG. 3, the lever 22 of the coupling device strikes against the front end of the support rail 3 or the friction face 24, is tilted into the perpendicular position and latches into the recess 23 in the pull-out rail 5. The pull-out rail 5 is thus coupled to the central rail 6, and the two rails 5, 6 are together moved further in the closing direction until the slide 9 strikes against the front end of the support rail 9 by means of its stop 8.

Once the drawer 1 has moved in slightly, the central rail 6 is coupled to the pull-in device 20, the pull-in device 20 acting on the rear end of the central rail 6. At this stage the central rail 6 is pulled further into the furniture carcass together with the pull-out rail 5, this movement being damped by the damper 10. This means that the drawer runs into the furniture carcass very smoothly.

When the drawer 1 is pull out, first of all the pull-out rail 5 remains coupled to the central rail 6, and these are moved outward together until the lever 22 leaves the support rail 3 and is tilted into the position shown in FIG. 1. This releases the coupling between the pull-out rail 5 and the central rail 6. Then the friction roller 21 runs on the friction face 24 of the support rail 3, and there is a different displacement of the rails 5 and 6.

The restoring spring integrated in the damper 10 brings the damper 10 back into the ready position.

What is claimed is:

1. A pull-out guide assembly for use on a furniture drawer, comprising:

a pull-out rail for use on a drawer side;

a support rail for use on a furniture body side;

a slide which is displaceably guided on said pull-out rail, said slide having a stop;

a counter stop positioned so that said slide comes to abut said counter stop with said stop of said slide before said pull-out rail reaches a rear end position during push-in movement of said pullout rail relative to said support rail; and a damper operable to damp push-in movement of said pull-out rail before said pull-out rail reaches the rear end position, said damper being operable between said pull-out rail and said slide;

wherein said slide is guided displaceably on said pull-out rail when said damper is operable to damp push-in movement.

2. The pull-out guide assembly of claim 1, wherein said damper is borne by said slide and said pull-out rail has an abutment for said damper.

3. The pull-out guide assembly of claim 1, wherein said counter stop is positioned at a front end of said support rail.

4. The pull-out guide assembly of claim 1, wherein a central rail is arranged displaceably between said support rail and said pull-out rail.

5. The pull-out guide assembly of claim 4, wherein said counter stop is positioned at a front end of said central rail.

6. The pull-out guide assembly of claim 4, and further comprising a coupling to couple said pull-out rail with said central rail at a rearward region of displacement.

7. The pull-out guide assembly of claim 1, wherein said damper is a fluid damper.

8. The pull-out guide assembly of claim 7, wherein said fluid damper comprises a liquid as damping fluid.

9. The pull-out guide assembly of claim 7, wherein said fluid damper comprises air as damping fluid.

10. The pull-out guide assembly of claim 1, wherein said damper has a piston which can move linearly in a cylinder.

11. The pull-out guide assembly of claim 1, wherein said slide is arranged at a front end of said pull-out rail.

12. The pull-out guide assembly of claim 1, and further comprising a guide secured to or formed on said pull-out rail for guiding said slide, said guide having an abutment constructed thereon for abutting said damper.

13. The pull-out guide assembly of claim 1, wherein said slide comprises a housing having a hollow and said damper is inserted into said hollow of said housing.

14. The pull-out guide assembly of claim 13, wherein said slide comprises a screw and said damper comprises a cylinder fixable in said slide with said screw.

15. The pull-out guide assembly of claim 1, and further comprising a guide for guiding said slide, said guide having a U-shaped arrangement surrounding said slide.

16. The pull-out guide assembly of claim 1, wherein said stop of said slide projects downwardly in a functional position of said pull-out rail.

17. The pull-out guide assembly of claim 1, wherein said slide is displaceably guided on an upper side of a running web of said pull-out rail.

18. The pull-out guide assembly of claim 1, wherein said damper is held in a tube which is tiltably borne on said slide.

19. The pull-out guide assembly of claim 1, and further comprising a pull-in device for pulling said pull-out rail into a rearmost position thereof.

20. The pull-out guide assembly of claim 19, wherein a central rail is arranged displaceably between said support rail and said pull-out rail, and further comprising a coupling to couple said pull-out rail with said central rail at a rearward region of displacement, and wherein said pull-in device acts on said central rail.

* * * * *